US005570518A

United States Patent [19]

Mistrater

[11] Patent Number: 5,570,518

[45] Date of Patent: Nov. 5, 1996

[54] DRYING METHOD USING GAS STREAMS THAT ARE DIRECTED AT A TANGENTIAL ANGLE TO SUBSTRATE SURFACE

[75] Inventor: Alan B. Mistrater, Rochester, N.Y.

[73] Assignee: Xerox Corporation, Stamford, Conn.

[21] Appl. No.: 407,123

[22] Filed: Mar. 20, 1995

[51] Int. Cl.[6] ..... F26B 7/00

[52] U.S. Cl. ..... 34/437; 34/48.7; 239/290; 239/568

[58] Field of Search ..... 34/104, 437, 439, 34/487; 239/290, 292, 299, 568

[56] References Cited

U.S. PATENT DOCUMENTS

| | | | |
|---|---|---|---|
| 1,871,666 | 8/1932 | Dallas | 230/568 |
| 4,779,355 | 10/1988 | Petros | 34/23 |
| 5,068,979 | 12/1991 | Wireman et al. | 34/58 |
| 5,357,687 | 10/1994 | Swain | 34/247 |
| 5,385,759 | 1/1995 | Crump et al. | 427/430.1 |

*Primary Examiner*—Henry A. Bennett
*Assistant Examiner*—Dinnatia Doster
*Attorney, Agent, or Firm*—Zosan S. Soong

[57] ABSTRACT

There is disclosed a method for drying a cylindrically-shaped substrate having a wet coating thereon which is oriented in a substantially vertical direction comprising directing a plurality of gas streams at a tangential angle against the substrate surface around the circumference of the substrate, wherein there is a plurality of imaginary lines on the substrate surface which are parallel to the longitudinal axis of the substrate, one imaginary line intersecting one gas stream, wherein each gas stream is directed upwards at an acute angle with the intersecting imaginary line, thereby reducing the gas pressure above a portion of the substrate surface which promotes drying of the coating.

11 Claims, 4 Drawing Sheets

DRYING METHOD USING GAS STREAMS THAT ARE DIRECTED AT A TANGENTIAL ANGLE TO SUBSTRATE SURFACE

This invention relates generally to a method for drying a substrate having a wet coating thereon involving directing a plurality of gas streams at the coating. In particular, the drying method, useful during the fabrication of for example a photosensitive member, creates a partial vacuum above the substrate surface to promote evaporation of solvents in the wet coating.

Conventional air rings typically blow a stream of air directly at the wet surface of a substrate as it emerges from a coating solution. The main purpose of this air stream is to dry or disperse the vapors of the solvents in the wet coating. Conventional air rings are somewhat effective in this objective. However, they are all limited by the principle that the air stream velocity cannot be too forceful or too direct since an excessively forceful or excessively direct air stream will tend to disrupt the coating. Also when the coating stays wet for too long, this may cause the coating to run or sag, which may lead to a defective photoreceptor.

Xerox has used an air ring designated "Turbo-Ring" for several years in the fabrication of photoreceptors. The Turbo-Ring uses tangentially angled fins which theoretically aim the plurality of air streams at a tangential angle to the substrate surface around the circumference of the substrate. However, in operation, the air slots of the Turbo-Ring are aimed directly at the base of the next adjacent air slot which effectively uses each and every air slot to blow the adjacent air stream off and away from the surface of the substrate, thereby rendering every air slot useless except for the minor effect of increasing the air flow in the general environs of the substrate. There is also no upward component of air movement relative to the vertically oriented cylindrically-shaped substrate.

Thus, there is a need, which the present invention meets, for a drying method which promotes the evaporation of a solvent from a wet substrate coating.

The following patent document may be relevant:

Crump et al., U.S. Pat. No. 5,385,759, discloses substrate coating methods and apparatus.

SUMMARY OF THE INVENTION

The present invention is accomplished in embodiments by providing a method for drying a cylindrically-shaped substrate having a wet coating thereon which is oriented in a substantially vertical direction comprising directing a plurality of gas streams at a tangential angle against the substrate surface around the circumference of the substrate, wherein there is a plurality of imaginary lines on the substrate surface which are parallel to the longitudinal axis of the substrate, one imaginary line intersecting one gas stream, wherein each gas stream is directed upwards at an acute angle with the intersecting imaginary line, thereby reducing the gas pressure above a portion of the substrate surface which promotes drying of the coating.

BRIEF DESCRIPTION OF THE DRAWINGS

Other aspects of the present invention will become apparent as the following description proceeds and upon reference to the Figures which represent preferred embodiments.

Unless otherwise noted, the same reference numeral in the Figures refers to the same or similar feature.

DETAILED DESCRIPTION

The present invention involves directing a plurality of gas streams at a tangential angle against the substrate surface around the circumference of the substrate, wherein the plurality of gas streams is also directed upwards at an acute angle to the substrate surface. Unless otherwise indicated, the phrases substrate surface, surface of the substrate, and similar expressions refer to the surface of the coating coated onto the substrate.

Figure 1:
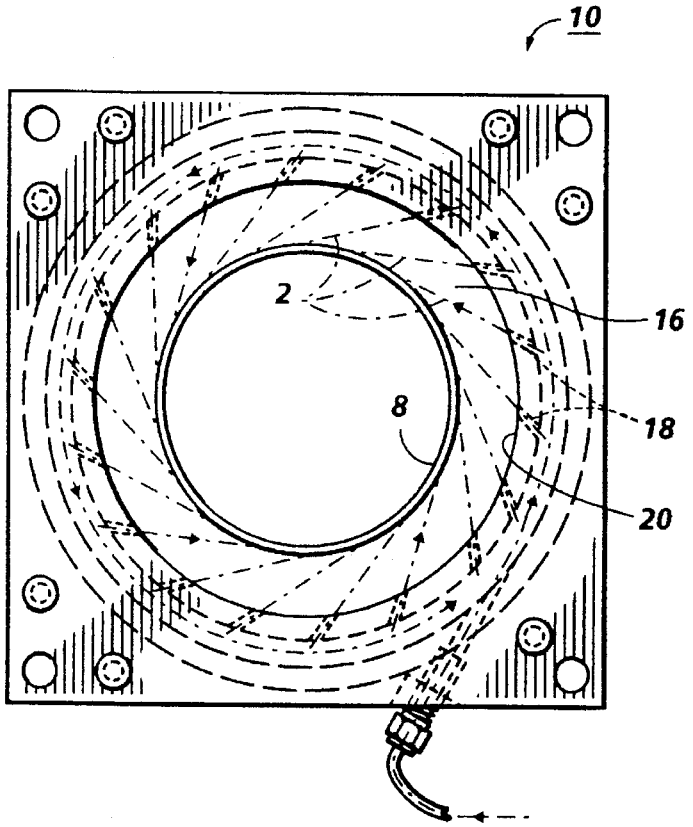
FIG. 1 represents a schematic top view of a gas dispersion apparatus employing the instant method to dry a substrate.
Figure 4:
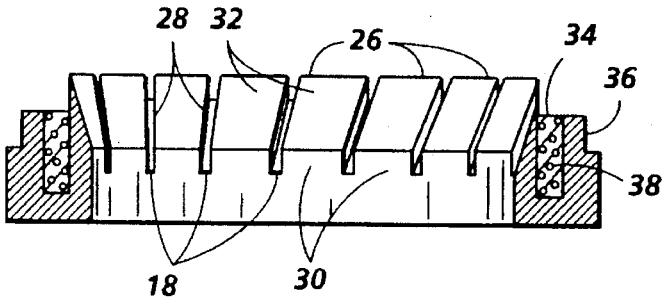
FIG. 4 represents a cross-sectional view along section 4—4 of the upper piece illustrated in FIG. 3.
Figure 5:
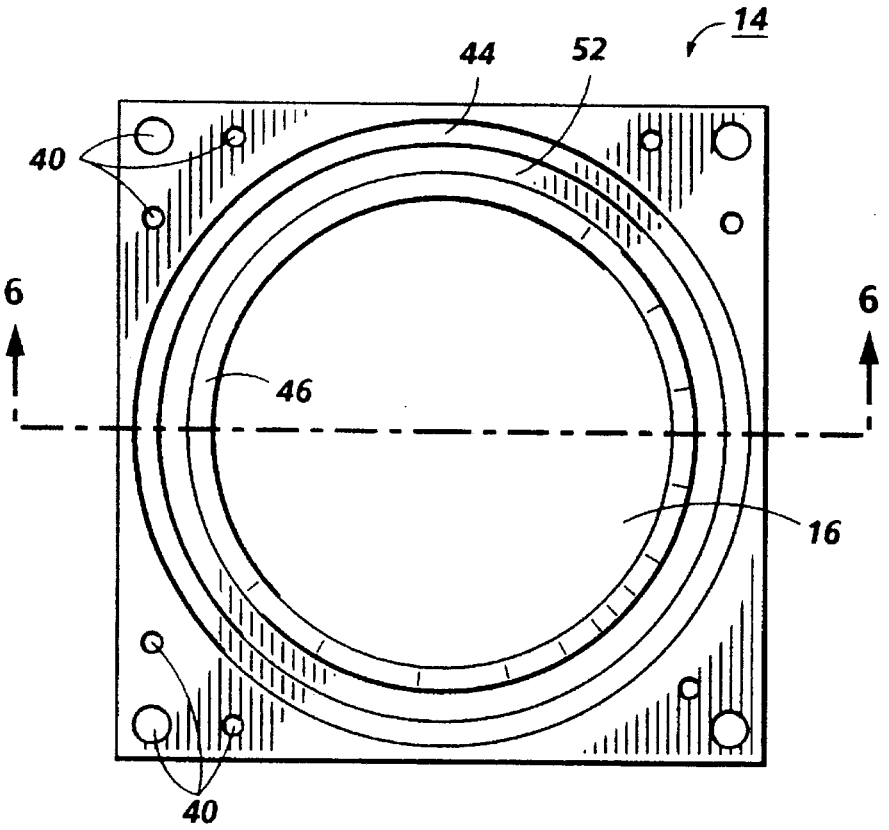
FIG. 5 represents a plan view of the lower piece of the gas dispersion apparatus.
Figure 6:
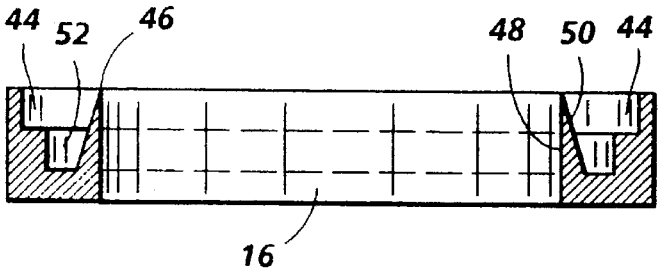
FIG. 6 represents a cross-sectional view along section 6—6 of the lower piece illustrated in FIG. 5.

To illustrate the direction of the plurality of gas streams 2, FIG. 1 represents a top view of a hollow, cylindrically-shaped substrate 8 having a wet coating thereon disposed in a preferred gas dispersion apparatus 10 comprised of an upper piece 12 (see FIGS. 3–4) coupled to a lower piece 14 (see FIGS. 5–6). The gas dispersion apparatus 10 defines a central opening 16 to accommodate the substrate 8 and further defines a plurality of gas slots 18 disposed around the the inner circumference 20 of the apparatus 10. Thus, the plurality of gas slots 18 surrounds the substrate circumference and the gas slots are spaced at the same or different intervals ranging for example from about 2 mm to about 1 cm, preferably from about 5 mm to about 15 mm, around the inner circumference of the gas dispersion apparatus. Preferably, the gas slots are on the same plane. The gas slots direct a plurality of gas streams at a tangential angle to the substrate surface which means that each gas stream contacts the substrate surface at a single area or point ("tangent point") at a 90 degrees angle relative to an imaginary line (not shown) which bisects the cross-sectional diameter of the substrate and which intersects the tangent point. A tangential angle is preferred since there is no hard point of impact by the gas streams on the surface of the substrate which may disrupt the coating.

Figure 2:
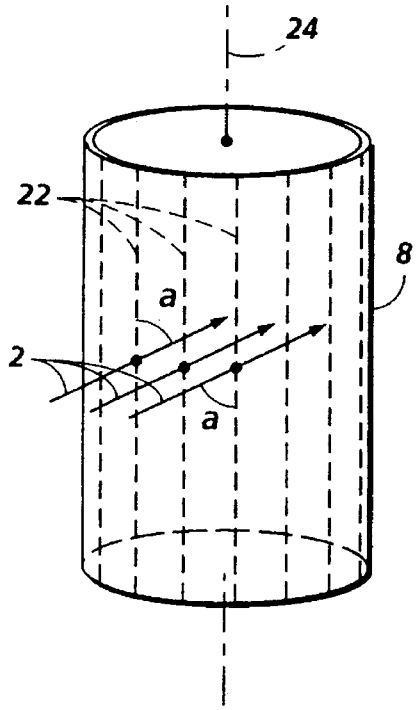
FIG. 2 represents a perspective view of the vertically oriented substrate and the direction of the plurality of gas streams across the substrate surface.

To further illustrate the direction of the plurality of gas streams 2, FIG. 2 represents a perspective view of a vertically positioned, hollow, cylindrically-shaped substrate 8 having a wet coating thereon where the gas dispersion apparatus is not shown for clarity. A plurality of imaginary lines 22 on the substrate surface is parallel to the longitudinal axis 24 of the substrate, one imaginary line 22 intersecting one gas stream 2. Each gas stream is directed upwards at an acute angle a to the intersecting gas stream. The acute angle a may be the same or different value for the various gas streams. The acute angle may range for example from about 25 to about 75 degrees, preferably from about 35 to about 50 degrees, and more preferably about 45 degrees. The upwards direction of the gas streams may minimize sagging of the wet coating since the frictional contact between the gas streams and the substrate surface tends to support the coating.

The gas streams may range in number from about 10 to about 70, preferably from about 16 to about 50, and more preferably from about 25 to about 40. The gas streams are directed at the substrate surface at a pressure ranging for example from about 10 to about 100 pounds per square inch ("psi"), preferably from about 20 to about 80 psi, and more preferably from about 40 to about 60 psi. The gas streams may be comprised of any suitable gas including for example, air, nitrogen, oxygen, carbon dioxide, or mixtures thereof.

The principle underlying the instant invention is analogous to the creation of an airfoil by directing an airsteam over or across a curved surface. The airfoil has certain desirable and beneficial properties such as having a partial vacuum or a lower pressure region over the apex and the far side (relative to the approaching airstream) of the curved surface. The creation of an airfoil based on the principles of fluid dynamics is well known. It is also well known that a lower pressure region over the airfoil will promote evaporation of liquids on the curved surface. Accordingly, in the present invention, directing the plurality of the gas streams at the direction described herein against the substrate surface reduces the gas pressure above a portion of the substrate surface, preferably the entire substrate surface, which promotes drying of the coating by increasing the evaporation of the solvent molecules in the coating. In embodiments, the plurality of lower pressure regions created by the gas streams is overlapping, surrounds the entire circumference of the substrate, and extends along a portion of the length of the substrate. In preferred embodiments, directing the plurality of the gas streams at the substrate surface creates a vortex of whirling gas around the circumference of the substrate along a portion of the length of the substrate, preferably along the entire substrate length, whereby the vortex reduces the gas pressure above the portion of substrate surface exposed to the vortex, preferably above the entire substrate surface, which promotes drying of the coating. A vortex tends to be self-perpetuating and with the proper geometry and velocity the vortex will extend over and upwards of the entire substrate length, thereby extending the drying zone. The following parameters are preferred to promote the creation of a vortex: a plurality of gas streams such as 30; directing the gas streams at a tangential angle against the substrate surface around the circumference of the substrate; directing the gas streams upward at an angle a of about 45 degrees; ejecting the gas stream at the substrate surface at a pressure of about 50 psi.

The instant invention is useful for any wet coating thickness and for the evaporation of any solvent in the coating. The instant invention is particularly useful for high vapor point solvents and thicker films. In fact, the efficacy may be most pronounced in any attempt to move from conventionally used hydrocarbon solvents, which are relatively volatile, to less volatile (i.e., environmentally friendly) solvents. The instant invention may be used to dry the coating as the substrate emerges from the coating solution.

Figure 3:
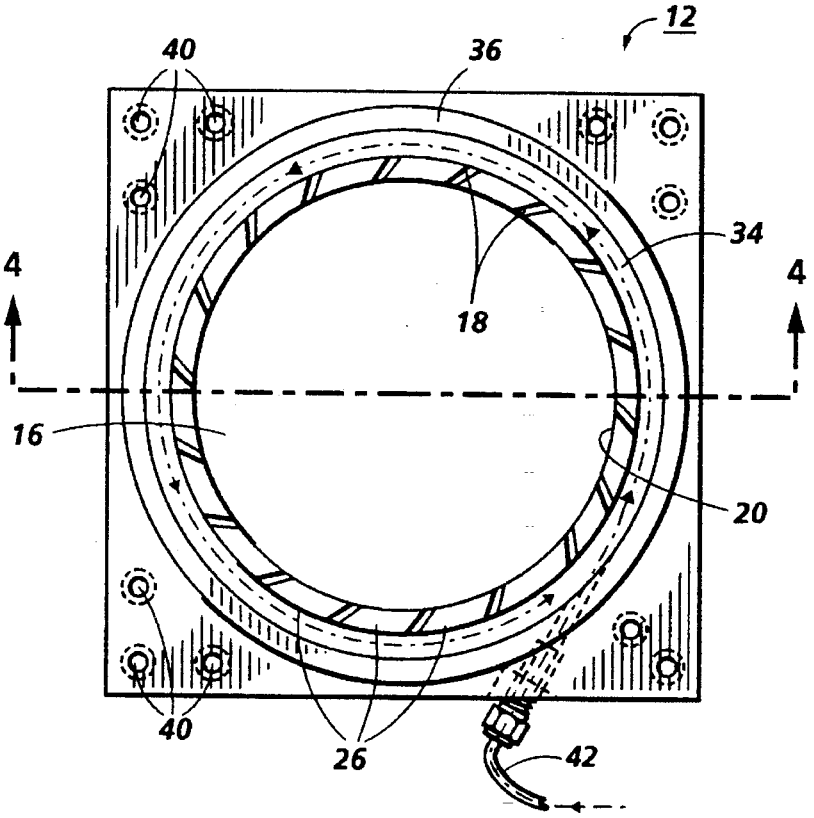
FIG. 3 represents a plan view of the upper piece of the gas dispersion apparatus.

FIGS. 3–4 represent views of the upper piece 12 of the gas dispersion apparatus 10. The upper piece 12 defines a circular central opening 16 to accommodate the substrate. A plurality of teeth members 26 are disposed around the inner circumference 20 of the upper piece. The teeth members may range in number from about 10 to about 70, preferably from about 16 to about 50, and more preferably from about 25 to about 40. Gas slots 18 are defined between adjacent teeth elements. The side surfaces 28 of each teeth element may be bevelled to direct the gas stream at the desired angle to the substrate surface. The surface of each teeth member facing the central opening is comprised of a flat region 30 and an inclined surface region 32. The inclined surface region 32 of the teeth members is inclined in a direction away from the central opening 16. A concentric channel 34 is disposed between the teeth members 26 and a concentric collar 36. A porous material 38 such as polyethylene felt or high density—high porosity polyurethane is positioned in the channel 34. The upper piece 12 also includes a number of openings 40 for coupling devices like screws or bolts. A gas inlet 42 is in communication via a passageway to the channel 34.

FIGS. 5–6 represent views of the lower piece 14 of the gas dispersion apparatus 10. The lower piece defines a circular central opening 16 to accommodate the substrate and defines a number of openings 40 for coupling devices like screws or bolts. The lower piece 14 includes a concentric depression 44. A concentric wall 46 surrounds the central opening 16 and is inclined towards the central opening. The wall 46 has an inner surface 48 which faces the central opening 16 and an outer surface 50 which faces the depression 44. A concentric groove 52, deeper than the depression 44, is defined in the lower piece between the wall 46 and the depression 44.

Figure 7:
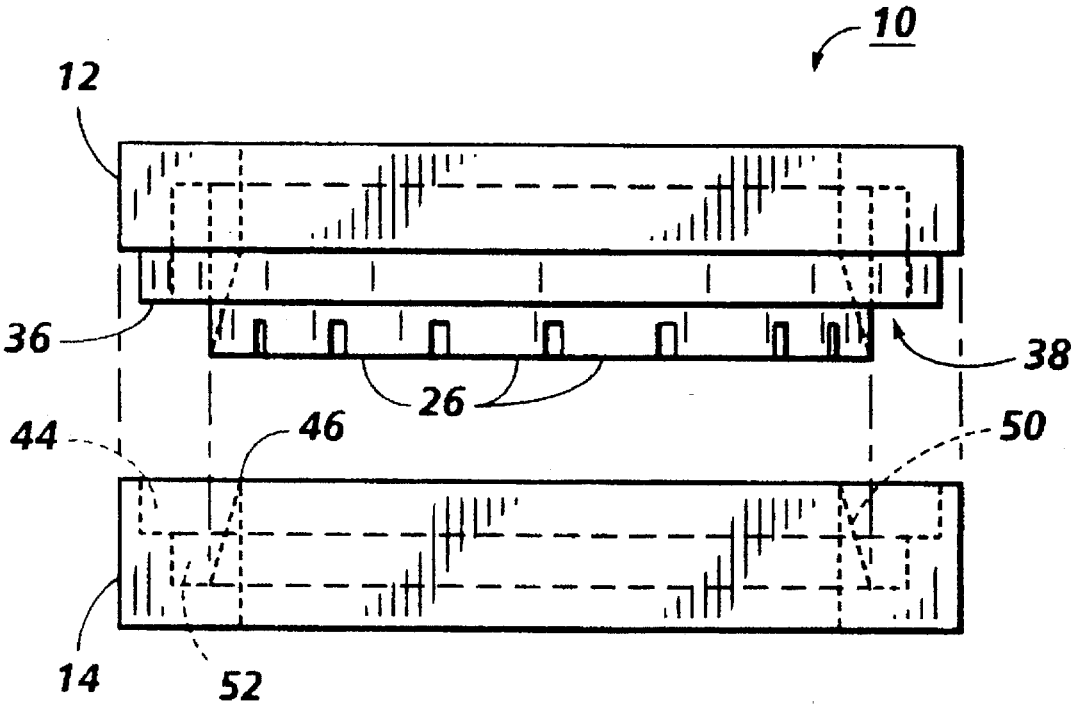
FIG. 7 represents a side view of the joining of the lower piece to the upper piece to form the gas dispersion apparatus.

FIG. 7 represents the coupling of the lower piece 14 to the upper piece 12. The depression 44 of the lower piece contacts the collar 36 of the upper piece. The inclined surface region 32 of the teeth members 26 contacts and is covered by the outer surface 50 of the wall 46. The flat region 30 of each teeth member remains exposed. Preferably, the porous material 38 does not penetrate into concentric groove 52 and thus groove 52 defines a gas passageway. The assembled gas dispersion apparatus operates as follows: gas enters the gas inlet 42 and flows via the channel 34 and the porous material 38 to the concentric groove 52. The gas exits from the concentric groove 52 into the central opening 16 through the gas slots 18 between the flat regions 30 of the teeth members 26. The substrate may be moved vertically within the central opening of the gas dispersion apparatus to permit the plurality of gas streams to dry the coating along the entire length of the substrate.

The gas dispersion apparatus may be fabricated from a metal such as steel, iron, or aluminum.

The substrate can be made of any suitable material such as aluminum, nickel, zinc, chromium, conductive paper, stainless steel, cadmium, titanium, metal oxides, polyesters such as MYLAR®, and the like.

The coating is formed using well known techniques and materials. For example, the coating can be applied to the substrate by vacuum deposition, immersion, spray coating, or dip coating. Dip coating or spray coating are preferred. Suitable coating techniques and materials are illustrated in U.S. Pat. Nos. 5,091,278, 5,167,987 and 5,120,628, the entire disclosures of which are totally incorporated herein by reference. The coating may have a thickness ranging for example from about 10 to about 100 microns, preferably from about 20 to about 60 microns.

The coating may be applied onto the substrate from any suitable coating solution. The coating solution may comprise any suitable liquid including solutions typically employed to coat layered material on the substrate during fabrication of photosensitive or photoconductive members. For example, the coating solution may comprise components for the charge transport layer and/or the charge generating layer, such components and amounts thereof being illustrated for instance in U.S. Pat. No. 4,265,990, U.S. Pat.

No. 4,390,611, U.S. Pat. No. 4,551,404, U.S. Pat. No. 4,588,667, U.S. Pat. No. 4,596,754, and U.S. Pat. No. 4,797,337, the disclosures of which are totally incorporated by reference. In embodiments, the coating solution may be formed by dispersing a charge generating material selected from azo pigments such as Sudan Red, Dian Blue, Janus Green B, and the like; quinone pigments such as Algol Yellow, Pyrene Quinone, Indanthrene Brilliant Violet RRP, and the like; quinocyanine pigments; perylene pigments; indigo pigments such as indigo, thioindigo, and the like; bisbenzoimidazole pigments such as Indofast Orange toner, and the like; phthalocyanine pigments such as copper phthalocyanine, aluminochloro-phthalocyanine, and the like; quinacridone pigments; or azulene compounds in a binder resin such as polyester, polystyrene, polyvinyl butyral, polyvinyl pyrrolidone, methyl cellulose, polyacrylates, cellulose esters, and the like. In embodiments, the coating solution may be formed by dissolving a charge transporting material selected from compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and the like, and hydrazone compounds in a resin having a film-forming property. Such resins may include polycarbonate, polymethacrylates, polyarylate, polystyrene, polyester, polysulfone, styrene-acrylonitrile copolymer, styrene-methyl methacrylate copolymer, and the like.

The coating solution may also comprise materials typically employed as a subbing layer, barrier layer, adhesive layer, and the like. Accordingly, the coating solution may comprise, for example, casein, polyvinyl alcohol, nitrocellulose, ethyleneacrylic acid copolymer, polyamide (nylon 6, nylon 66, nylon 610, copolymerized nylon, alkoxymethylated nylon, and the like), polyurethane, gelatin, polyester, polyvinylbutyral, polyvinylpyrrolidone, polycarbonate, polyurethane, polymethyl methacrylate, and the like as well as mixtures thereof.

Other modifications of the present invention may occur to those skilled in the art based upon a reading of the present disclosure and these modifications are intended to be included within the scope of the present invention.

I claim:

1. A method for drying a cylindrically-shaped substrate having a wet coating thereon which is oriented in a substantially vertical direction comprising directing a plurality of gas streams at a tangential angle against the substrate surface around the circumference of the substrate, wherein each gas stream is directed upwards at an acute angle with an imaginary line on the substrate surface parallel to the longitudinal axis of the substrate wherein the imaginary line intersects the gas stream, thereby reducing the gas pressure above a portion of the substrate surface which promotes drying of the coating, wherein the plurality of the gas streams promotes the drying of the coating without disrupting the coating.

2. The method of claim 1, wherein there is directed the plurality of the gas streams ranging in number from about 10 to about 70 against the substrate surface.

3. The method of claim 1, wherein the plurality of the gas streams is comprised of air.

4. The method of claim 1, wherein there is directed the plurality of the gas streams against the substrate surface at a pressure ranging from about 10 to about 100 psi.

5. The method of claim 1, wherein each gas stream is directed at the acute angle ranging from about 25 to about 75 degrees with the intersecting imaginary line.

6. The method of claim 1, wherein each gas stream is directed at the acute angle ranging from about 35 to about 50 degrees with the intersecting imaginary line.

7. The method of claim 1, wherein each gas stream is directed at the acute angle of about 45 degrees with the intersecting imaginary line.

8. The method of claim 1, further comprising moving the substrate vertically to permit the plurality of the gas streams to dry the coating along the entire length of the substrate.

9. The method of claim 1, wherein directing the plurality of the gas streams at the substrate surface creates a vortex of whirling gas around the circumference of the substrate along a portion of the length of the substrate, whereby the vortex reduces the gas pressure above the portion of substrate surface exposed to the vortex which promotes drying of the coating.

10. The method of claim 1, wherein directing the plurality of the gas streams creates a vortex of whirling gas around the circumference of the substrate along the entire length of the substrate, whereby the vortex reduces the gas pressure above the entire substrate surface to promote drying of the coating.

11. The method of claim 1, wherein directing the plurality of the gas streams reduces the gas pressure above the entire substrate surface which promotes drying of the coating.

* * * * *